US009458650B2

(12) United States Patent
Votruba et al.

(10) Patent No.: US 9,458,650 B2
(45) Date of Patent: Oct. 4, 2016

(54) ENDGATE RETAINER PIN ASSEMBLY

(75) Inventors: Edward J. Votruba, Chandler, AZ (US); Robert A. Dolan, Gilbert, AZ (US)

(73) Assignee: U-Haul International, Inc., Phoenix, AZ (US)

( * ) Notice: Subject to any disclaimer, the term of this patent is extended or adjusted under 35 U.S.C. 154(b) by 687 days.

(21) Appl. No.: 12/491,127

(22) Filed: Jun. 24, 2009

(65) Prior Publication Data

US 2010/0327608 A1 Dec. 30, 2010

(51) Int. Cl.

| | |
|---|---|
| ***E05C 5/04*** | (2006.01) |
| ***E05C 1/04*** | (2006.01) |
| ***E05B 63/12*** | (2006.01) |
| *E05B 17/20* | (2006.01) |
| *E05C 5/02* | (2006.01) |

(52) U.S. Cl.

CPC ..... *E05C 1/04* (2013.01); *E05B 63/12* (2013.01); *E05B 63/125* (2013.01); *E05B 17/2026* (2013.01); *E05C 5/02* (2013.01); *Y10T 292/0863* (2015.04)

(58) Field of Classification Search

CPC .... E05B 65/0007; E05B 83/16; E05B 83/18; E05B 63/12; E05B 63/125; E05B 17/2026; E05C 5/00; E05C 5/02; E05C 1/04; E06B 11/02; E06B 11/021

USPC ..... 292/57, 340, DIG. 29, 58, 63, 64, 67, 292/183, 184, 189, 230, 231, 238, 300, 302, 292/304, DIG. 40, DIG. 43

See application file for complete search history.

(56) References Cited

U.S. PATENT DOCUMENTS

| | | | | |
|---|---|---|---|---|
| 107,398 | A * | 9/1870 | Mooney | 312/199 |
| 305,138 | A * | 9/1884 | Bourke | 292/58 |
| 532,151 | A * | 1/1895 | Funk | 292/58 |
| 595,427 | A * | 12/1897 | Adams | 292/238 |
| 1,568,689 | A * | 1/1926 | Nystrom | 292/337 |
| 1,723,007 | A * | 8/1929 | Bittorf | 292/57 |
| 2,403,065 | A * | 7/1946 | Engert | 292/57 |
| 3,298,728 | A * | 1/1967 | Dye | 292/62 |
| 3,561,804 | A * | 2/1971 | Brown | 292/58 |
| 4,482,177 | A * | 11/1984 | Nagy | 292/156 |
| 5,275,029 | A * | 1/1994 | Myers | 70/128 |
| 5,707,095 | A | 1/1998 | Pribak et al. | |
| 5,947,540 | A | 9/1999 | Pariseau et al. | |
| 5,992,916 | A | 11/1999 | Kass et al. | |
| 6,471,279 | B2 | 10/2002 | Pommeret | |
| 7,303,218 | B2 | 12/2007 | Kraenzle | |

* cited by examiner

*Primary Examiner* — Alyson M Merlino

(74) *Attorney, Agent, or Firm* — Richard E. Oney; Tiffany & Bosco, P.A.

(57) ABSTRACT

A latch assembly is provided for a holding a vehicle endgate in a closed position. The assembly includes a latch pin having a main shaft disposed generally along an axis and a projection that is spaced apart from and projects toward the main shaft axis. A first receiving member is connected to one of a vehicle frame and the endgate and has a hole for receiving the latch pin main shaft. A second receiving member is connected to the other of the frame and the endgate and has a hole for receiving the latch pin main shaft. The first receiving hole and the second receiving member hole are in alignment when the endgate is in the closed position. The first receiving member includes an inclined annular groove for receiving the latch pin projection. When the latch pin projection is disposed in the annular groove, gravity will impede the latch pin projection from exiting the groove.

18 Claims, 8 Drawing Sheets

30
34a
31
34
30a
38
35b
30b
32
34b
36
39
34b
37
35a 30
30b
31
32
C 30
34a
30a
36
32
37
31
34
34b
35a
D 30
33a
38
37
31
35b
34a
34
30a
30b
34b
39
33b 34
34b
36
37
34a
39
33
30
34b
30a
35a
38
30b

ENDGATE RETAINER PIN ASSEMBLY

BACKGROUND

The present invention relates to a latch assembly for holding a vehicle endgate in a closed position. More particularly, it relates to such a latch assembly that will prevent the latch pin from disengaging when the vehicle is in motion and is subject to vibration.

A conventional latch pin retaining system for a trailer endgate has two retaining tubes, one of which is connected to the rear of the trailer and the second of which is connected to the endgate. With this system, when the endgate is in a closed position, the two retaining tubes are in alignment. Such a system is shown in FIG. 1. As shown in FIG. 1, to secure the endgate in this closed position, the latch pin is inserted through the aligned retaining tubes. One drawback of this conventional system is that, when the trailer hits a bump, pot hole, or the like, the resulting impact can cause the pin to bounce or launch out of the retaining tubes.

There is a need, therefore, for an endgate retainer pin assembly that addresses the foregoing problem. It is an object of the present invention to provide such an apparatus.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, there is provided a latch assembly for a holding a vehicle endgate in a closed position. The assembly includes a latch pin having a main shaft disposed generally along an axis and a projection that is spaced apart from and projects toward the main shaft axis. A first receiving member is connected to one of the vehicle frame and the endgate and has a hole for receiving the latch pin main shaft. A second receiving member is connected to the other of the frame and the endgate and has a hole for receiving the latch pin main shaft. The first receiving member hole and the second receiving member hole are in alignment when the endgate is in the closed position. The first receiving member includes an inclined annular groove for receiving the latch pin projection.

According to one aspect of the invention, the inclined annular groove is oriented so that when the first receiving member is in a generally upright position and the latch pin projection is disposed in the annular groove, gravity will impede the latch pin projection from exiting the annular groove.

According to another aspect of the invention the first receiving member includes an upper annular inclined surface facing generally upward with a slot disposed at the lower side of the inclined surface and sized to receive the latch pin projection. The upper annular inclined surface generally has a width greater than the spacing between the latch pin projection and main shaft and is oriented so that when the latch pin is inserted into the receiving members with the latch pin projection resting on the upper annular inclined surface, gravity urges the latch pin projection towards the slot. In one advantageous embodiment, the annular groove is disposed below the upper annular inclined surface and has an incline that generally opposes the incline of the upper annular inclined surface. The slot is in communication with the inclined annular groove. In this configuration, when the first receiving member is in a generally upright position and the latch pin projection is resting on the upper annular surface, gravity will urge the latch pin projection toward the slot. Also, when the latch pin projection is disposed in the annular groove, gravity will urge the latch pin projection away from the slot.

The first receiving member can be fabricated from a first tubular member, a second tubular member disposed about the first tubular member, and a third tubular member disposed about the first tubular member and spaced apart from the second tubular member to form the inclined annular groove. Each of the second and third tubular members has a generally triangular side profile with a notch in a portion of its periphery. The slot is defined, at least in part, by the notch in the periphery of one of the second and third tubular members.

BRIEF DESCRIPTION OF THE DRAWINGS

The accompanying drawings, which are incorporated in and constitute a part of the specification, illustrate the presently preferred embodiments and methods of the invention and, together with the general description given above and the detailed description of the preferred embodiments and methods given below, serve to explain the principles of the invention.

DESCRIPTION

Figure 1:
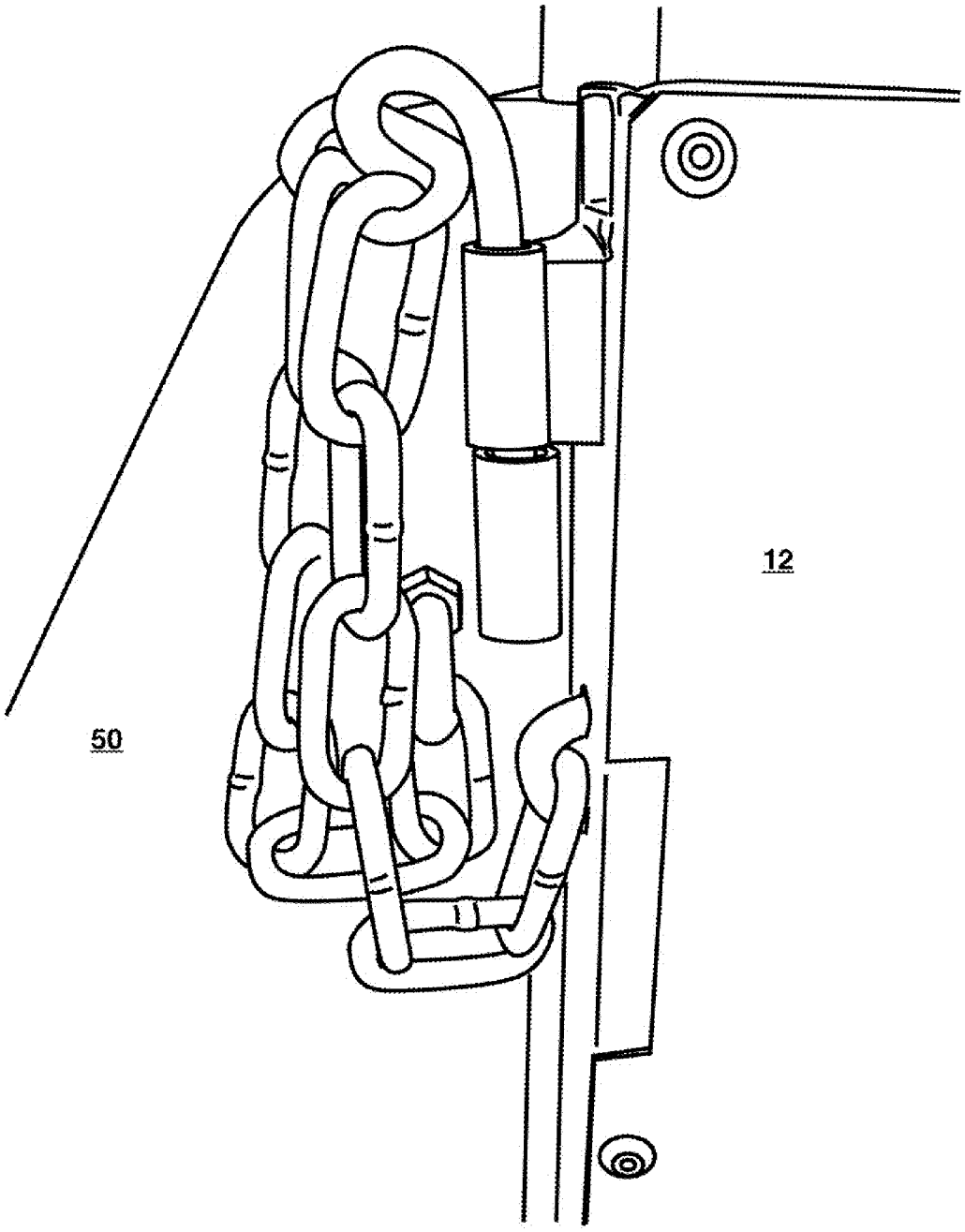
FIG. 1 Prior Art
FIG. 1 is a perspective view of a conventional latch pin retaining assembly for a trailer endgate showing the endgate in the closed position with the latch pin inserted in the retaining tubes.

Reference will now be made in more detail to presently preferred embodiments of the invention, as illustrated in the accompanying drawings. While the invention is described more fully with reference to these examples and drawings, the invention in its broader aspects is not limited to the specific details, representative devices, and illustrative examples shown and described. Rather, the description which follows is to be understood as a broad, teaching disclosure directed to persons of ordinary skill in the appropriate arts, and not as limiting upon the invention.

It will be appreciated that terms such as "upper," "inner," "outer," "vertical," "horizontal," "bottom," "below," "top," "side," "inwardly," "outwardly," "downwardly" and "lower" and other positionally descriptive terms used in this specification are used merely for ease of description and refer to the orientation of the referenced components as shown in the Figures. It should be understood that any orientation of the components described herein is within the scope of the present invention. The term "generally" as used in this specification is defined as "being in general but not necessarily exactly or wholly that which is specified." For example, "generally perpendicular" is used herein to indicate components that are in general, but not necessarily exactly or wholly, perpendicular.

In the drawings, the reference numeral 10 designates a latch assembly in accordance with the invention. The latch assembly 10 includes a latch pin 20, a tubular upper receiving member 30 mounted to the trailer frame 50 and a tubular lower receiving member 40 mounted to the endgate 12 so that the tubular receiving members 30, 40 are aligned, with the upper receiving member 30 positioned above the lower receiving member 40, when the endgate 12 is in the closed position. Upon reading this specification, it will be understood by those of skill in the art that in other configurations the upper receiving member 30 could be mounted to the endgate 12 and the lower receiving member 40 could be mounted to the frame 50.

Figure 3:
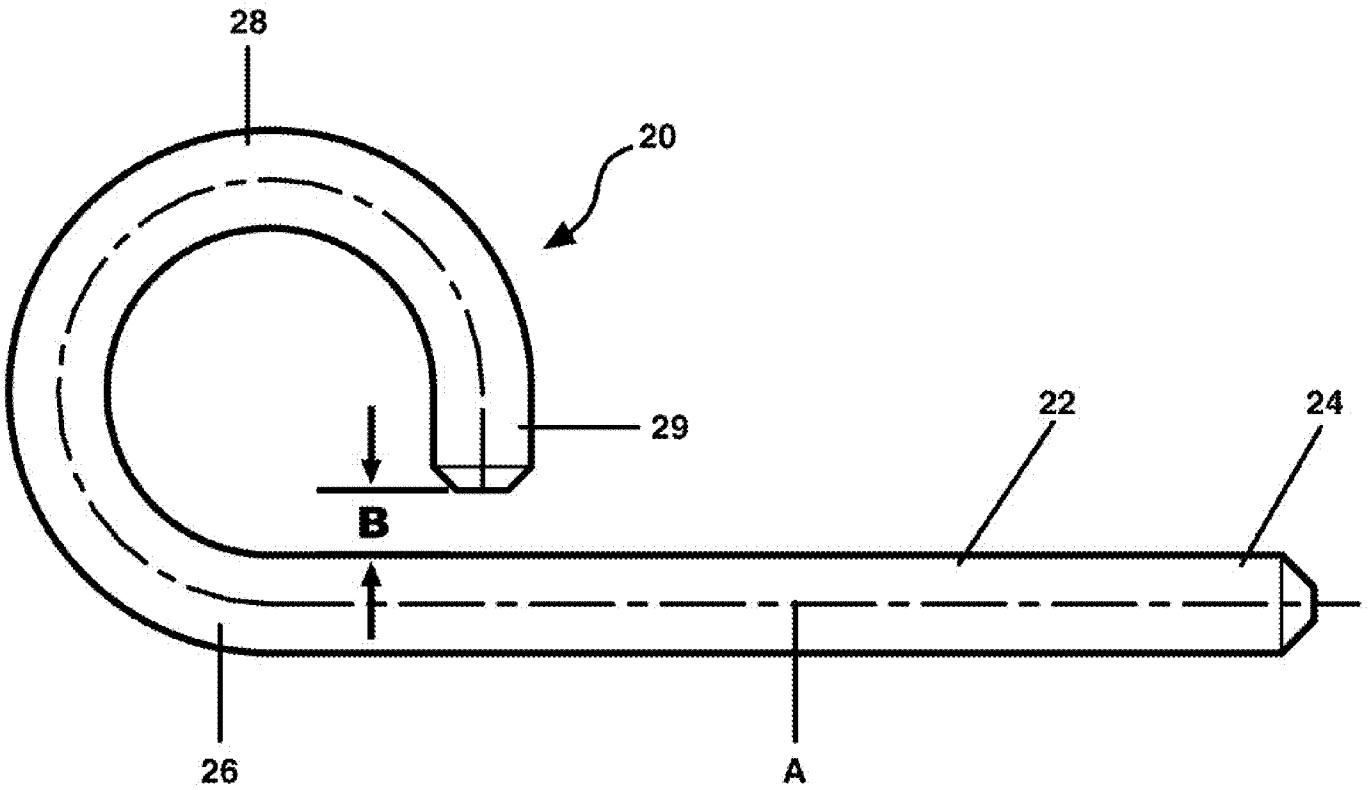
FIG. 3 is a side view of the latch pin of the assembly of FIG. 2.
Figure 4:
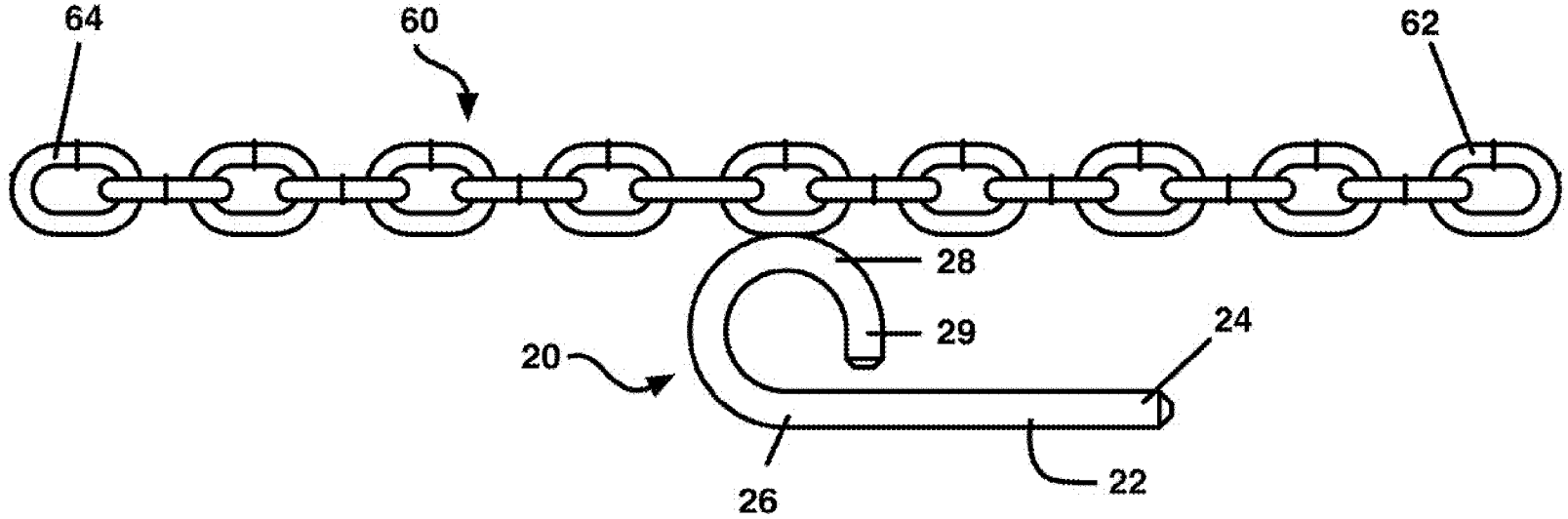
FIG. 4 is side view of the latch pin of FIG. 3 showing a chain attached to the curved portion of the pin.

As shown in FIGS. 3 and 4, the latch pin 20 has a main shaft 22 disposed generally along a longitudinal axis A and having first and second opposing ends 24, 26. Disposed at the main shaft second end 26 is a curved portion 28 that is integrally attached to the main shaft 22 and terminates in a projection 29 that is spaced apart a distance B from and projects toward and generally perpendicular to the main shaft 22. In one preferred embodiment, the main shaft 22 and the curved portion 28 are made of an integral piece of metal bar stock and the curved portion 28 is formed by bending an end of the metal bar stock toward the main shaft 22.

Referring to FIG. 4, the latch pin 22 is coupled to chain 60 intermediate the ends 62, 64 of the chain. In the embodiment shown in FIG. 4, the chain 60 is formed of metal links and is attached to the latch pin curved portion 28 by a weld. Upon reading this specification, it will be understood by those of skill in the art that that the chain 60 can be coupled to the latch pin 20 by other means. For example, as shown in FIGS. 2 and 11, the latch pin 20 can include an eye 25 welded to the curved portion for coupling with a link of the chain 60.

Figure 2:
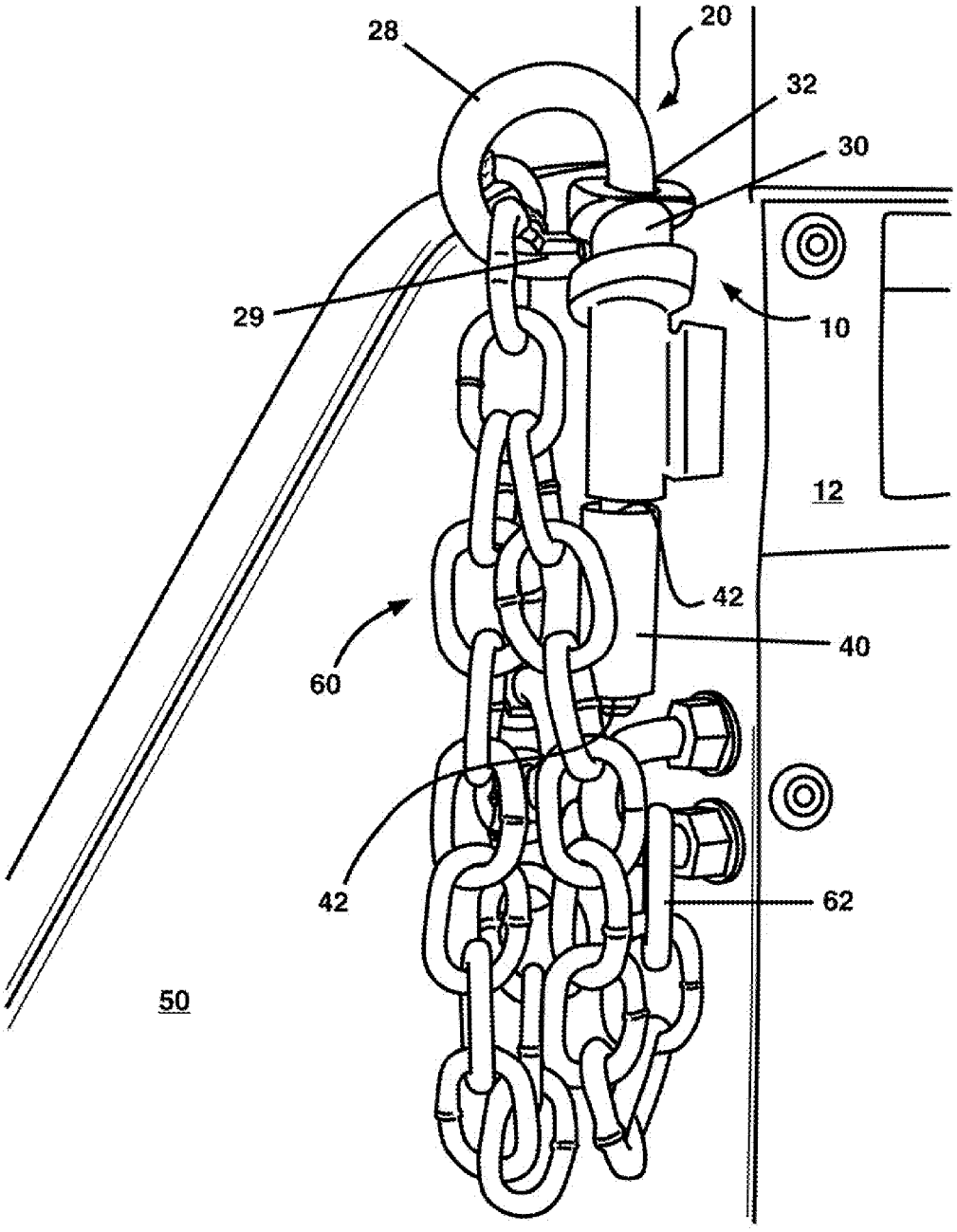
FIG. 2 is a perspective view of one embodiment of an endgate retainer pin assembly in accordance with the present invention, showing the endgate in the closed position and the latch pin inserted into the upper receiving member and the lower receiving member.
Figure 5:
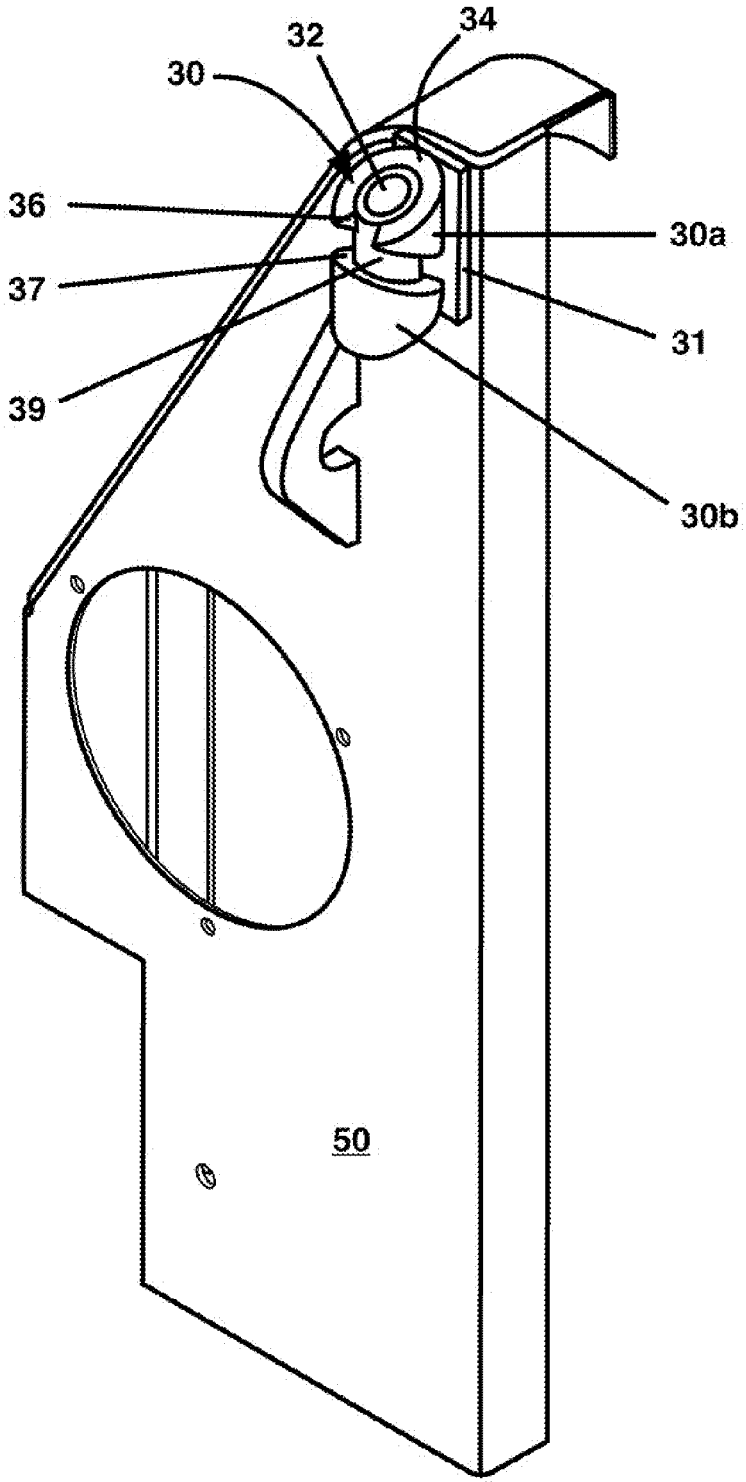
FIG. 5 is a perspective view of a tail light housing panel of a trailer frame showing one preferred embodiment of the upper receiving member of the latch pin assembly mounted to a frame panel.
Figures 6, 7, 8, 9, 10:
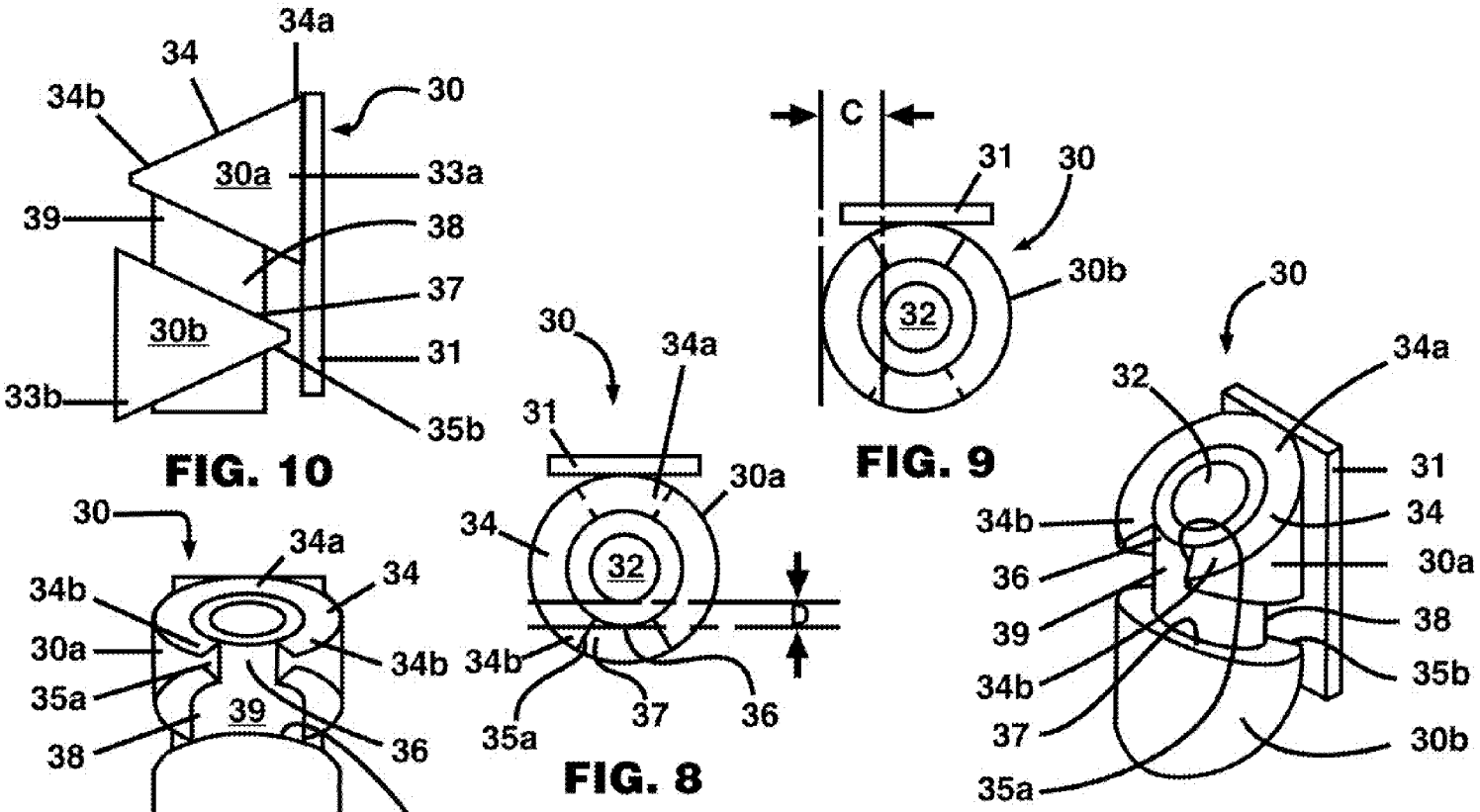
FIG. 6 is a perspective view of the upper receiving member of the latch pin assembly of FIG. 5.
FIG. 7 is a front elevational view of the upper receiving member of FIG. 6.
FIG. 8 is a top plan view of the upper receiving member of FIG. 6.
FIG. 9 is a bottom plan view of the upper receiving member of FIG. 6.
FIG. 10 is a side elevational view of the upper receiving member of FIG. 6.
Figure 11:
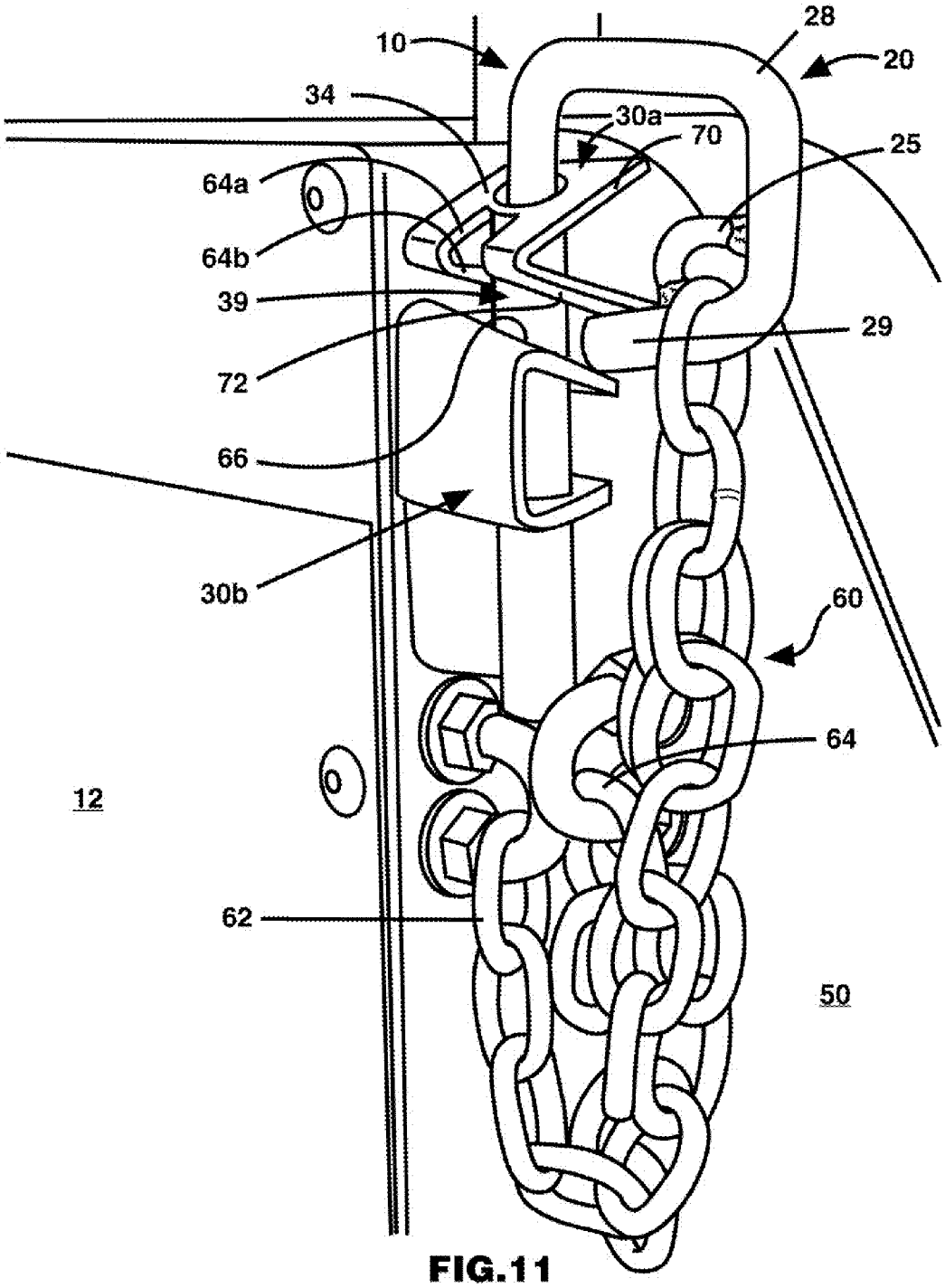
FIG. 11 is a perspective view of an alternative embodiment of an endgate retainer pin assembly in accordance with the present invention, showing the endgate in the closed position and the latch pin inserted into the upper receiving member and the lower receiving member.
Figure 12:
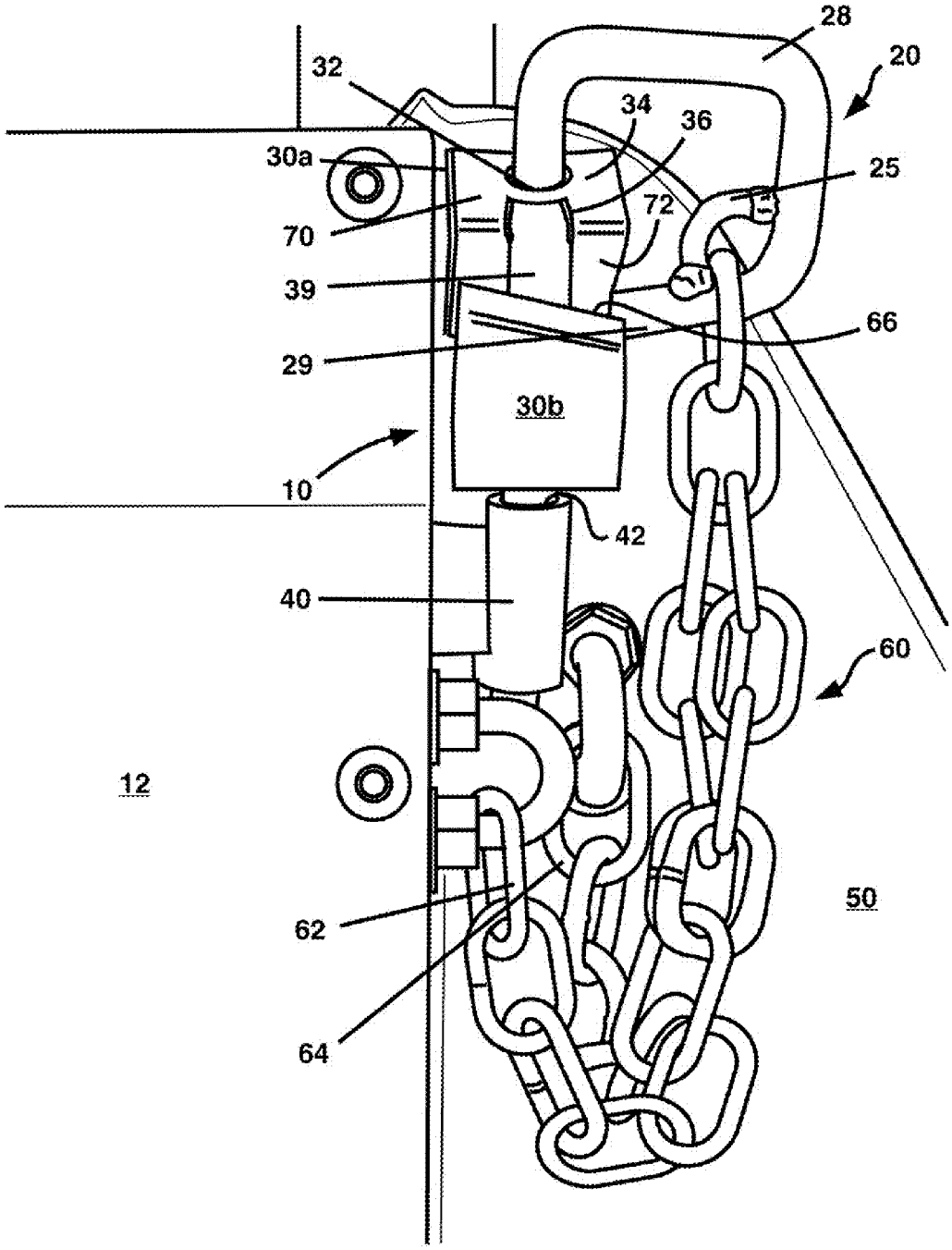
FIG. 12 is an elevational view of the endgate retainer pin assembly of FIG. 11.

Referring to FIGS. 2, 5 and 11, the upper receiving member 30 is fixed to the trailer frame 50. The upper receiving member 30 includes a hole in the form of a bore 32 extending through its length, which is sized for slidingly receiving the latch pin main shaft 22. The lower receiving member 40 is fixed to the endgate 12 and includes a bore 42 extending through its length and sized for slidingly receiving the latch pin main shaft 22. The upper and lower receiving members 30, 40 are positioned so that upper receiving member bore 32 and the lower receiving member bore 42 are in alignment when the endgate 12 is in the closed position, as shown in FIG. 2. As can be best seen in FIG. 11, one chain end 62 is coupled to the endgate 12 and the other chain end 64 is coupled to the trailer frame 50 for holding the endgate 12 generally parallel to the ground when the endgate 12 is in a fully open position.

Referring to FIGS. 5-10, in one preferred embodiment, the upper receiving member 30 includes a mounting plate 31 for mounting the member 30 to the trailer frame 50 (see FIG. 5). The upper receiving member 30 has an upper annular portion 30*a* with an enlarged diameter that defines an inclined upper annular surface 34 generally facing upward. The inclined upper annular surface 34 has an upper side 34*a* and a lower side 34*b*. The annular surface 34 generally has a width C that is larger than the space B between the latch pin main shaft 22 and the latch pin projection 29. A lower annular portion 30*b* of the upper receiving member 30 also has an enlarged diameter and is spaced apart from the upper portion 30*a*.

A slot 36 is disposed at the lower side 34*b* of the annular surface 34 and is sized to loosely receive the latch pin projection 29 when it is aligned with the slot 36. At the slot 36, the width D of the upper annular surface 34 is smaller than the space B between the latch pin main shaft 22 and the latch pin projection 29. The lower annular portion 30*b* has a generally upward facing inclined upper annular surface 37, which has an incline that generally opposes the incline of the upper annular surface 34. The lower annular portion 30*b* is disposed in relation to the upper annular portion 30*a* so as to define an annular groove 38 disposed between the upper portion 30*a* and the lower portion 30*b*. The annular groove 38 is sized to receive the latch pin projection 29 and to allow for movement of the latch pin projection 29 within the annular groove 38 as the latch pin main shaft 22 rotates within the bores 32, 42. The incline of the annular groove 38 generally opposes the incline of the upper annular surface 34. In this configuration, when the upper receiving member 30 is in a generally upright position, and the latch pin 20 is inserted with the latch pin projection 29 resting on the upper annular surface 34, gravity will urge the latch pin projection 29 to rotate toward the slot 36.

Still referring to FIGS. 6-10, in one advantageous embodiment, the upper receiving member 30 comprises three sections of tubular metal stock, such as tube steel. The mounting plate 31 is formed of plate metal stock, such as plate steel. One tubular section comprises an inner tubular member 39, which defines the bore 32. One end of this tubular section is cut at an angle to form a portion of the inclined upper annular surface 34. Each of the two larger tubular sections 33*a*, 33*b* is cut with a side profile generally in the shape of an isosceles triangle (see FIG. 10). These larger tubular sections 33 are sized to slidingly fit over either end of the inner tubular member 39 to form the upper annular portion 30*a* and the lower annular portion 30*b* of the upper receiving member 30. A notch 35 is formed in each of the larger tubular sections 33. Each of the larger tubular sections 33 is fixed to the mounting plate 31, such as by welding. To form the upper annular portion 30*a*, one of the larger tubular sections 33*a* is attached to the mounting plate 31 so that the notch 35*a* is opposite the mounting plate 31. In this configuration, the notch 35*a* forms the slot 36 of the upper receiving member 30. To form the lower annular portion 30*b*, the other of the larger tubular sections 33*b* is attached to the mounting plate 31 and the inner tubular member 39, such as by welding, so that the notch 35*b* faces the mounting plate 31.

Referring to FIG. 2, the operation of the endgate retainer pin assembly 10 of the present invention will now be described. When the endgate 12 is in the closed position, the receiving members 30, 40 are aligned with the upper receiving member 30 positioned above the lower receiving member 40. To latch the endgate 12 in the closed position, the latch pin main shaft 22 is inserted into the upper receiving member bore 32. To allow for full insertion of the latch pin 20 into both receiving member bores 32, 42, the latch pin 20 is rotated so that the latch pin projection 29 is aligned with the upper receiving member slot 36. This allows the projection to enter the annular groove 38 and come to rest on the inclined upper annular surface 37. From this position, rotation of the latch pin 20 causes the latch pin projection 36 to travel down the annular groove 38 until it comes to rest in a locked position with the latch pin projection 36 engaging the mounting plate 31. To remove the latch pin 20 and open the endgate 12, the latch pin 20 must be rotated so that the latch pin projection 26 travels up the annular groove 38 into alignment with the upper receiving member slot 36. From this position, the latch pin 20 can be lifted out of the receiving members 30, 40, allowing the endgate 12 to be opened.

Advantageously, the endgate retainer pin assembly 10 of the present invention provides a self-locking feature that holds the latch pin 20 in place and reduces the potential for inadvertent disengagement of the latch pin 20. With the latch pin 20 in the locked position described above, the annular groove 38 restricts the latch pin 20 from upward movement (absent rotation of the latch pin 20). Because the annular groove 38 is inclined, gravity urges the latch pin 20 into the locked position and restricts inadvertent rotation of the latch pin 20. Thus, vibration from movement of the vehicle will urge the latch pin 20 into the locked position. In this manner, the endgate retainer pin assembly 10 prevents the latch pin 20 from inadvertently bouncing out of the receiving members 30, 40 in response to driving vibrations. Yet, the latch pin 20 is easy to remove by manually rotating it into alignment with the upper receiving member slot 36 and then lifting it out of the receiving members 30, 40.

The endgate retainer pin assembly 10 of the present invention also advantageously provides a self-insertion feature. If the latch pin 20 is only partially inserted into the upper receiving member 30 such that the latch pin projection 29 rests on the inclined upper annular surface 34, gravity will urge the projection pin 29 toward and into the slot 36. In this manner, the upper receiving member 30 provides a self-indexing feature for aligning the latch pin projection 29 to the slot 36. Once the projection pin 29 enters the slot 36, it will drop into the annular groove 38. As discussed above, the annular groove 38 is slanted so that gravity will urge the projection pin 29 away from the slot 36, causing the latch pin 20 to move into the locked position. Thus, if the user inserts the latch pin 20 only partially into the upper receiving member 30 and the vehicle begins moving, the resulting vibrations will tend to cause the latch pin 20 to automatically align with the slot 36 and move into the locked position.

FIG. 11 illustrates an alternative embodiment of an endgate retainer pin assembly 10 in accordance with the present invention. In this embodiment, the latch pin 20 includes an eye 25 welded to the latch pin curved portion 28, which has a generally rectangular shape with curved corners. The upper receiving member 30 includes the inner tubular member 39, which defines the bore 32. The upper annular portion 30*a* comprises a metal plate that is bent so as to have a triangular side profile, thereby forming an upper plate 70 and a lower plate 72, through which the inner tubular member 39 extends. Notches 64*a*, 64*b* are disposed in each of the upper and lower plates 70, 72 to form the slot 36 for receiving the latch pin projection 29. The lower annular portion 30*b* of the upper receiving member 30 comprises a plate that is bent to from an upper plate 66 through which the inner tubular member 39 extends. This upper plate 66 is disposed at an angle so that it has an incline that generally opposes the incline of the upper annular surface 34 and that also slopes downward toward the outer part of the trailer frame 50. In this configuration, the lower plate 72 of the upper annular portion 30*a* and the upper plate 66 of the lower annular portion 30*b* define the upper and lower bounds of the annular groove 38 for retaining the latch pin projection 29.

From the foregoing it should be apparent that endgate retainer pin assembly of the present invention provides a number of advantages over previous retainer pin assemblies. It provides a self-locking feature that prevents the latch pin from inadvertently disengaging from the tubular receiving members on the endgate and vehicle frame, such as sometimes occurs with prior latch assemblies when vibrations cause the latch pin to bounce out of the receiving members. In addition, the assembly of the present invention provides a self-insertion feature whereby vibrations urge the latch pin to fully insert itself into the receiving members and to move into the locked position. Yet, the user can easily remove the latch pin by rotating it so that it can be pulled it out of the receiving members. The endgate retainer pin assembly of the present invention can be used on any open trailer gate, tailgate, ramp gate or similar gate applications.

Having read this disclosure, it will also be understood by those having skill in the art that modifications may be made to the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. A latch assembly for holding a vehicle endgate in a closed position, the assembly comprising:

a latch pin including a main shaft disposed generally along a main shaft axis and a projection that is spaced apart from and projects toward the main shaft axis;

a first receiving member connected to one of a trailer frame and the endgate and having a hole for receiving the latch pin main shaft; and a second receiving member connected to the other of the frame and the endgate and having a hole for receiving the latch pin main shaft, wherein the first receiving member hole and the second receiving member hole are in alignment when the endgate is in the closed position; and wherein the first receiving member includes an inclined annular groove for receiving the latch pin projection when the latch pin main shaft is disposed in the receiving member holes; and wherein the inclined annular groove is oriented so that when the latch assembly is in a generally upright position such that the main shaft axis is in a generally vertical orientation, and when the latch pin projection is disposed in the annular groove, a gravitational force will act generally parallel to the main shaft axis to impede the latch pin projection from exiting the annular groove.

2. The latch assembly of claim 1 wherein the first receiving member includes an inclined upper annular surface facing generally upward and oriented so that when the latch pin projection engages the upper annular surface, the gravitational force will urge the latch pin projection toward a slot in the upper annular surface.

3. The latch assembly of claim 1 wherein the first receiving member includes an inclined upper annular surface facing generally upward and having a slot disposed at a lower side of the inclined upper annular surface and sized to receive the latch pin projection, and wherein the annular groove is disposed below the inclined upper annular surface when the latch assembly is in the generally upright position.

4. The latch assembly of claim 2 wherein the incline of the annular groove generally opposes the incline of the inclined upper annular surface.

5. The latch assembly of claim 1 wherein the latch pin projection is generally perpendicular to the main shaft axis.

6. The latch assembly of claim 1 wherein the first receiving member includes:

a first tubular member;

a second tubular member disposed over the first tubular member; and a third tubular member disposed over the first tubular member and spaced apart from the second tubular member to form the inclined annular groove.

7. The latch assembly of claim 6 wherein at least one of the second and third tubular members has a generally triangular side profile.

8. The latch assembly of claim 6 wherein at least one of the second and third tubular members includes a notch in its periphery.

9. A latch assembly for holding a vehicle endgate in a closed position, the assembly comprising:

a latch pin including a main shaft disposed generally along a main shaft axis and a projection that is spaced apart from and projects toward the main shaft axis;

a first receiving means for receiving the latch pin main shaft; and a second receiving means for receiving the latch pin main shaft, wherein the first receiving means and the second receiving means are in alignment when the endgate is in the closed position; and means for defining an inclined annular groove for receiving the latch pin projection when the latch pin main shaft is disposed in the first and second receiving means;

wherein the inclined annular groove is oriented so that when the latch pin main shaft is disposed in the first and second receiving means and the latch pin projection is disposed in the annular groove, a force of gravity alone will impede the latch pin projection from exiting the annular groove.

10. The latch assembly of claim 9:

wherein the first receiving means includes an inclined upper annular surface facing generally upward and having a notch in its periphery; and wherein the inclined upper annular surface is oriented so that when the latch pin projection engages the inclined upper annular surface, a force of gravity will urge the latch pin projection toward the notch.

11. The latch assembly of claim 10 wherein the annular groove is disposed below the upper annular surface when the latch assembly is in the generally upright position.

12. The latch assembly of claim 10 wherein the incline of the annular groove generally opposes the incline of the upper annular surface.

13. The latch assembly of claim 9 wherein the latch pin projection is generally perpendicular to the main shaft axis.

14. A latch assembly for holding a vehicle endgate in a closed position with respect to a frame, the assembly comprising in combination:

a latch pin having a main shaft disposed generally along a main shaft axis and a projection that is spaced apart from and projects toward the main shaft;

an upper receiving member defining a first hole for receiving the latch pin main shaft;

a lower receiving member defining a second hole for receiving the latch pin main shaft, wherein the upper receiving member is fixedly coupled to one of the endgate or the frame and the lower receiving member is fixedly coupled to the other of the endgate or the frame and wherein the first and second holes are in alignment when the endgate is in the closed position;

an upper annular surface facing generally upward and inclined from a lower portion to an upper portion, wherein the upper annular surface generally has a width greater than the spacing between the latch pin projection and the main shaft;

an inclined annular groove disposed below the upper annular surface for receiving the latch pin projection, wherein the incline of the inclined annular groove generally opposes the incline of the upper annular surface; and a slot for receiving the latch pin projection, wherein the slot extends from the upper annular surface to the inclined annular groove;

whereby when the upper receiving member is in a generally upright position such that the main shaft axis is in a generally vertical orientation, and when the latch pin projection is resting on the upper annular surface, a gravitational force will act generally parallel to the main shaft axis and will urge the latch pin projection toward the slot and into the annular groove; and whereby when the upper receiving member is in the generally upright position such that the main shaft axis is in the generally vertical orientation, and when the latch pin projection is resting in the annular groove, the gravitational force will act generally parallel to the main shaft axis and will urge the latch pin projection away from the slot.

15. The latch assembly of claim 14 wherein the upper receiving member includes:

a first tubular member;

a second tubular member disposed over the first tubular member; and a third tubular member disposed over the first tubular member and spaced apart from the second tubular member to form the inclined annular groove.

16. The latch assembly of claim 15 wherein at least one of the second and third tubular members has a generally triangular profile.

17. The latch assembly of claim 15 wherein the slot is defined, at least in part, by a notch in the periphery of at least one of the second and third tubular members.

18. A latch assembly for holding a vehicle endgate in a closed position with respect to a frame, the assembly comprising:

a latch pin including a main shaft having a projection that is spaced apart from and projects toward the main shaft;

a first receiving member connected to one of the frame and the endgate and having a hole for receiving the latch pin main shaft; and a second receiving member connected to the other of the frame and the endgate and having a hole for receiving the latch pin main shaft, wherein the first receiving member hole and the second receiving member hole are in alignment when the endgate is in the closed position;

wherein the first receiving member includes a void for receiving the latch pin projection and the first receiving member is configured so that, when the latch pin main shaft is disposed in the first receiving member hole and the latch pin is in an unlocked position, the force of gravity alone will urge the latch pin to rotate from the unlocked position into a locked position wherein the latch pin projection is engaging the void of the first receiving member.

* * * * *